United States Patent [19]

Dodge

[11] Patent Number: 4,619,451

[45] Date of Patent: Oct. 28, 1986

[54] DRIVE ROLLER BIASING MECHANISM

[75] Inventor: Dennis W. Dodge, Amherst, N.H.

[73] Assignee: Itek Corporation, Lexington, Mass.

[21] Appl. No.: 666,946

[22] Filed: Oct. 31, 1984

[51] Int. Cl.[4] ..... B65H 5/06

[52] U.S. Cl. ..... 271/274; 100/171; 226/176; 198/624

[58] Field of Search ..... 271/272, 273, 274, 314; 198/836, 624, 628; 226/176, 177, 186, 187, 191, 194; 100/171

[56] References Cited

U.S. PATENT DOCUMENTS 3,338,495 8/1967 De La Motte ..... 226/187 X 4,522,520 6/1985 Takenoya et al. ..... 271/274 X

*Primary Examiner*—Bruce H. Stoner, Jr.

*Assistant Examiner*—Matthew C. Graham

*Attorney, Agent, or Firm*—Charles W. Fallow; Martin P. Hoffman; Mitchell B. Wasson

[57] ABSTRACT

Four pairs of paper drive rollers are provided which may be individually adjusted so that proper balancing of the bite pressures result. The same springs employed for this purpose are also utilized to maintain the mechanism locked and to provide rapid and easy opening of the mechanism to widely separate the rollers for the purpose of cleaning and preventing the rollers from being flattened due to continued application of bite pressure when the machine is not being used.

27 Claims, 4 Drawing Figures

DRIVE ROLLER BIASING MECHANISM

BACKGROUND OF THE INVENTION

The present invention relates to the field of drive mechanisms for transporting photosensitive film or paper to and from the exposure platen of a phototypesetter or the like.

In transporting photosensitive paper into the exposure station of a phototypesetter, it is important to provide balanced driving forces to prevent the feed direction of the paper from becoming skewed relative to the center line of the drive mechanism.

In a prior design, four drive rollers were mounted upon a drive shaft and were in contact with four pinch rollers and pressure adjustment springs, positioned about a central support bearing, were employed. With this unit, it was difficult to obtain balanced bite pressures at the roller interfaces as changes in the bite pressure of one roller pair, would affect the pressures of other pairs, such variations of pressure being caused by, for example, lack of concentricity of the rollers. In accordance with the present design, means are provided to widely separate the rollers in order to readily clear paper jams, clean rollers, and prevent the rollers from being flattened due to setting, when the machine is not being operated, and independent suspension of one roller of each roller pair is effected. Thus the bite pressure of each roller pair may be individually adjusted in accordance with a spring/set screw arrangement, without altering the bite pressures of other roller pairs.

It is thus an object of the present invention to provide a relatively simple mechanism for individually adjusting the bite pressures between four pair of drive rollers, and yet allow rapid and easy roller separation for the purposes setforth above.

It is a further object of the present invention to provide a mechanism for performing the above stated function which utilizes the same individually adjusted bite pressure springs to also lock and unlock the separation mechanism.

SUMMARY OF THE INVENTION

In accordance with a preferred embodiment of the invention, a spring loading link is rotatably coupled through a first pivot to the mechanism frame at a lower left hand portion thereof, and is rigidly coupled to a plurality of spring loaded plungers at upper portions thereof. The left hand portion of a handle link is pivotably coupled to the frame via a second pivot positioned above the first pivot, and in the closed position of the mechanism, has a right hand terminal portion mechanically biased against a stop. A left hand terminal portion of a toggle link is rotatably coupled to a lower portion of the handle link by a third pivot and a right hand portion thereof is rotatably coupled to a lower right hand portion of the spring loading link at a fourth pivot. A referencing line is defined as a straight line intersecting the fourth movable pivot of the toggle link and the second fixed pivot means supporting the handle link. The springs of the plungers are individually adjusted to provide the above stated appropriate roller nip pressures, and the upward reaction forces of the plunger springs accompanying the downward forces creating nip pressure create a counter-clockwise torque of the spring loading link about the first pivot, which causes the toggle link to in turn tend to induce clockwise rotation of the handle link to maintain it against the stop in the closed position. Upon upward manual counter-clockwise rotation of the handle link, the third pivot point at the left hand portion of the toggle link will now become positioned above the reference line, and such action will permit the reaction forces generated by the plunger springs to rotate the third pivot point of the toggle link about the second pivot point, to enable further counter-clockwise rotation of the handle link, assisted by the reaction forces, to open the mechanism. During opening, the toggle link will pull the fourth pivot point further upwardly to enable further rotation of the spring loading link producing separation of the plungers from the roller cradle links to remove the roller bite pressures. Since the roller cradle links are actuatable by spring loading link by a crossbar, full counter-clockwise rotation of the spring loading link will also pull the roller cradles and hence the pinch rollers rotatably mounted therein, away from the drive rollers which are rotatably mounted to the frame.

Since each roller cradle link is independently coupled to the frame, the varied roller bite pressures are mechanically isolated from each other in accordance with the above stated object of the invention.

Other objects, features, and advantages of the present invention will become apparent upon study of the following specific description taken in conjunction with the drawings in which.

SPECIFIC DESCRIPTION

Figure 1:
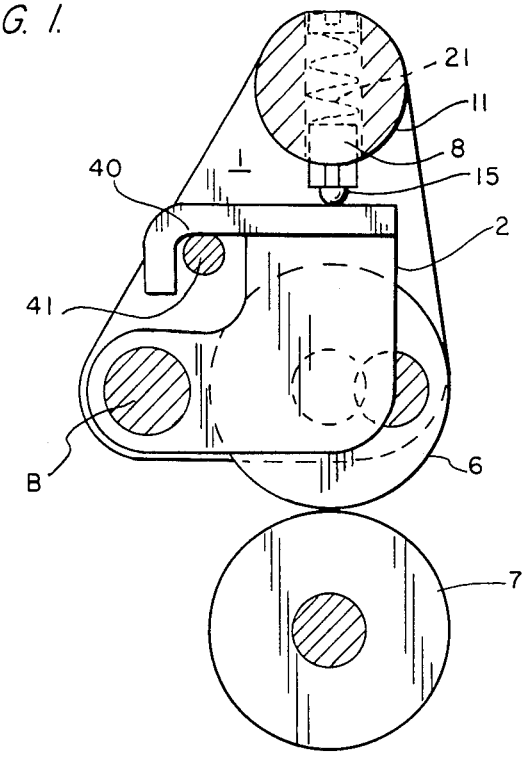
FIG. 1 illustrates a side view of a portion of an embodiment of the invention.
Figure 2:
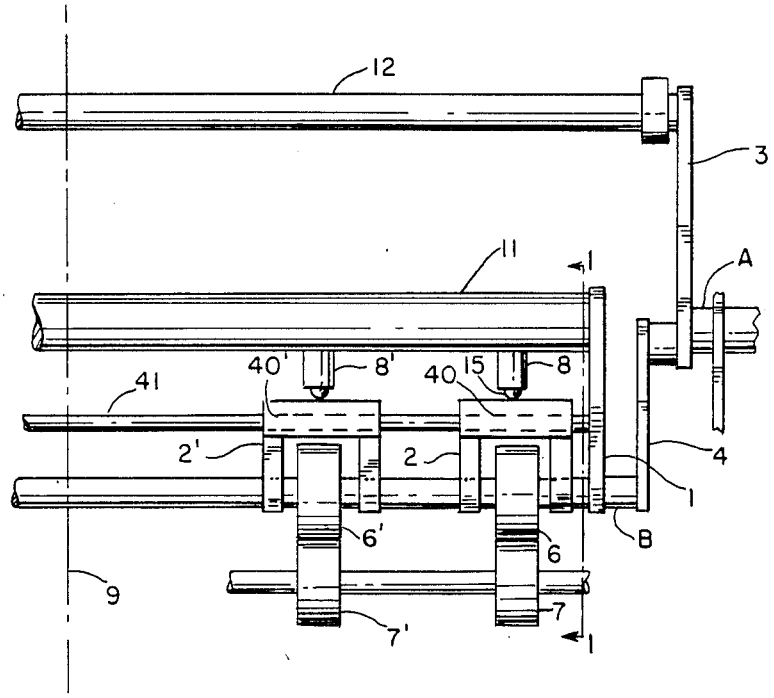
FIG. 2 illustrates a front view of such embodiment.

Referring now to FIGS. 1 and 2, pinch roller 6 is pressed against drive roller 7 when the mechanism is in a closed position. A second pair of similar rollers, 6' and 7' are illustrated in FIG. 2, along with center line 9 of the paper drive system. In the interest of brevity and economy, the other two pairs of rollers to the left of line 9 and corresponding to 6 and 7 together with 6' and 7' have been omitted. However, it should be understood that these additional pairs of rollers are also spring biased by individually adjusted spring loaded plungers, such as 8 and 8' shown in FIGS. 1 and 2, such plungers being affixed to the spring loading cross bar 11. The linkage mechanism to be described and illustrated at the right hand portion of FIG. 2, will also be duplicated at the left hand terminal portions of spring loading cross bar 11 and handle cross bar 12. In other words, the structure of FIG. 2 is mirror imaged about film or paper drive center line 9. As mentioned above, the spring loaded plungers 8 and 8', together with their counterparts at the left hand portion of center line 9, are individually adjusted to provide the desired drive forces at the nips of all four pairs of rollers.

In FIGS. 1 and 2, roller cradle link 2 is illustrated, pivoted about pivot point B and each cradle link 2, 2', will rotatably support and partially enclose a pinch roller 6 as shown in FIG. 2, and when the linkage mechanism is closed, each roller 6, and 6' will press against its associated drive roller 7, and 7' to provide the drive force for the film or other photosensitive material, since spring loaded plungers 8 and 8', contact and press against the upper portions of roller cradle links 2 and 2'. Screw cap 13 is utilized to adjust the normal pressure exerted by the spring loaded plunger tip 15 against the top of roller cradle link 2. Spring loading cross bar 11 is rigidly affixed to the upper portion of spring loading link 1 as illustrated in FIGS. 1 and 2, which link is pivotably mounted to the machine frame at pivot portion B. With the mechanism in the locked, closed position, all of the independently adjustable spring loaded plungers 8, 8', press downwardly against the tops of associated cradle links 2, 2', to produce the appropriate normal pressures at the nips of pinch rollers 6 and drive rollers 7, since rollers 6 are rotatably mounted within the roller cradle links.

It is important to note that each cradle link is independently rotatably coupled to the frame at B in FIG. 1, to thus isolate adjustment of normal pressure between each roller pair and the other roller pairs.

Figure 3:
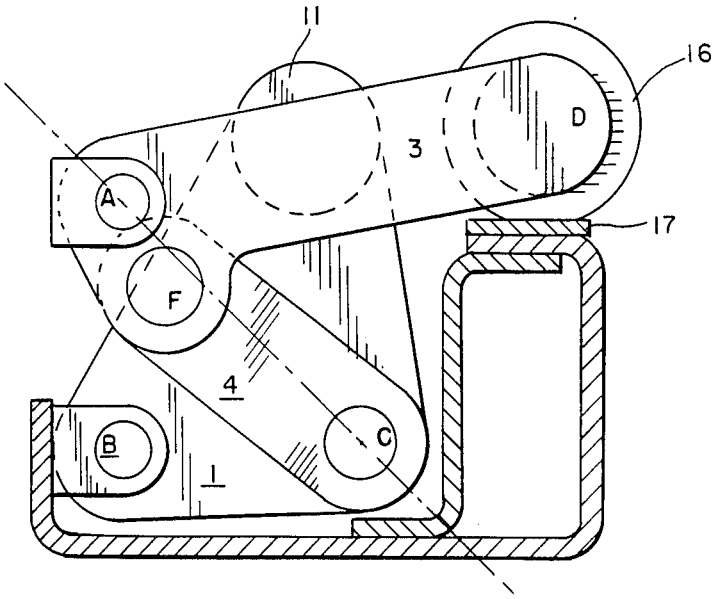
FIG. 3 illustrates a side view of the embodiment employing additional elements relative to those shown in FIG. 1.

Referring now to FIG. 3, triangular spring loading link 1 is pivoted about pivot support point B, whereas handle link 3 is pivotably supported about pivot point A and terminates at handle or toggle cross bar 12, bearing roller 16, affixed to the right hand terminal portion of link 3. With the mechanism in the closed, locked position, the lower portion of roller 16 at D will press against machine frame portion 17. Besides being pivoted about pivot point A, handle link 3 is rotatably coupled at pivot F to the left hand portion of toggle link 4, which in turn is pivotably coupled at point C to the lower right hand portion of spring loading link 1. The pivotable coupling points C and F of toggle link 4 are floating, that is they are not affixed to machine ground, in contrast with pivot points A and B.

In accordance with the present invention, the spring loading plungers 8 and 8', have a dual function. Besides properly establishing the desired appropriate variable roller bias forces normal to the contacting pinch/drive roller surfaces, the springs also function to maintain the mechanism in a closed or locked position when handle link 3 assumes the lowered position shown in FIG. 3, that is when the roller 16 mounted upon handle cross bar 12, is pressed against machine ground at point D.

Figure 4:
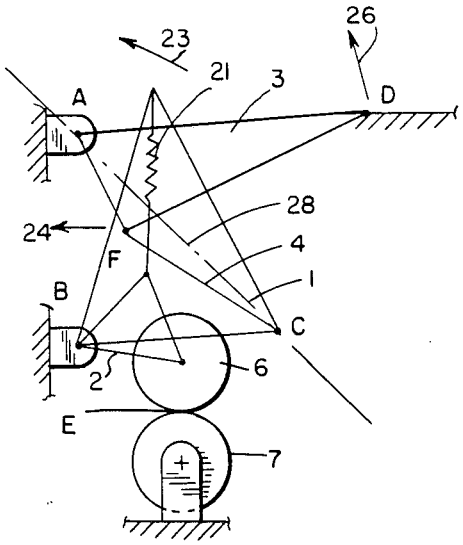
FIG. 4 illustrates a linkage diagram which may be helpful in understanding the operation of the embodiment of the invention.

The various linkages described above are also indicated in FIG. 4, and it will be seen that plunger spring 21, has an additional function besides downwardly applying the bite roller pressure, of creating an upward reaction force which tends to rotate spring loading link 1 in a counterclockwise direction about pivot B as indicated by arrow 23. However, such counterclockwise rotation would cause pivot point C to be displaced upwardly and to the left, by virtue of its rotation about pivot point B, which causes toggle link 4 to generate a force in the direction of arrow 24 at pivot point F. Since pivot point F is affixed to the lower portion of handle link 3, force 24 will tend to rotate handle link 3 in a clockwise direction about pivot point A. However, such counterclockwise motion will be prevented by the reaction forces at machine ground portion D, and thus the linkage system is maintained in a locked position by the compression of plunger spring 21.

Now let it be assumed that the operator wishes to open the mechanism for the purpose of cleaning the rollers, or the like. Handle cross bar 12 is upwardly displaced manually, as indicated by arrow 26 in FIG. 4, to cause pivot point F, and hence the left hand portion of toggle link 4 to be moved upwardly toward reference line 28. Spring 21 will continue to maintain the mechanism in a locked position, until pivot point F is finally pulled above or passes to the other side of reference line 28, at which time the force exerted at pivot point F, represented by arrow 24, due to spring 21 operating through link 1 and 4 described above, will now assist in the continued counter clockwise rotation of handle link 3 in the direction of arrow 26. As pivot F is now above reference line 28, force 24 produces a counter-clockwise torque about pivot A, rather than the clockwise torque produced when F was below reference line 28. Since spring loading link 1 is pivotably coupled to toggle link 4 at pivot point C, the spring loading link 1 will now be rotated in the direction of arrow 23 by being pulled by toggle link 4 at pivot point C. Such counter-clockwise motion of link 1 about pivot B, will produce a corresponding upward motion of roller cradle link 2 since the smaller diameter cradle cross bar 41 affixed to link 1 pushes upwardly against follower portion 40 of cradle link 2. See FIGS. 1 and 2.

In summary, the motion of pivot point F above the reference line 28, will enable motion of link 1 in the direction of arrow 23 to release the roller bite biasing force otherwise asserted by spring 21, to permit the handle to be further manually rotated, along with the pinch roller cradle links to fully open the mechanism. Thus the handle link may also be described as a roller position control link.

The entire process is reversed upon proceeding from the open position to the closed locked position, such that when pivot point F is pushed below reference line 28, by manually rotating handle 12 and handle link 3 clockwise about point A, the above stated upward reaction force produced by springs 21 of plungers 8 will cause link 4 to push against link 3 at pivot F to continue the clockwise rotation of handle link 3 until it is stopped by ground portion D of the machine frame.

While particular embodiments of the present invention have been shown and described, it is apparent that various changes and modifications may be made, and it is therefore intended that the following claims cover all such modifications and changes as may fall within the true spirit and scope of this invention.

I claim:

1. A mechanism for establishing individually adjustable roller bite bias pressures between paper drive roller means mounted upon a frame and a corresponding plurality of pinch rollers, shiftable with respect to said frame, comprising:

biasing link means having a first portion rotatably mounted upon said frame by a first pivot means;

a plurality of roller support means actuated by said biasing link means, each rotatably supporting one of said pinch rollers;

roller biasing isolation means for independently coupling each roller support means to said frame;

handle link means having a first portion thereof pivotably coupled to said frame by a second pivot means;

coupling link means having a first portion thereof rotatably coupled to a second portion of said handle link means by a third pivot means and having a second portion thereof coupled to a second portion of said biasing link means by a fourth pivot means;

a plurality of mechanical biasing means for asserting forces upon said pinch roller support means;

means for coupling said mechanical biasing means to said biasing link means for causing said pinch rollers to press against said drive roller means while producing a torque tending to rotate said roller position control link means about said second pivot means in a first direction for maintaining said handle link means in the closed position and for producing rotation of said handle link means about said second pivot means in a second direction opposite said first direction upon opening said mechanism to enable full separation of said pinch rollers from said drive roller means.

2. The combination as set forth in claim 1 wherein each of said pinch roller support means is individually coupled to rotate about said first pivot means and contains a pinch roller rotatably mounted therein.

3. The combination as set forth in claim 1 further including means for individually varying the forces asserted by each of said mechanical biasing means upon an associated pinch roller support means.

4. The combination as set forth in claim 3 wherein said drive roller means comprises a plurality of drive rollers, each associated with one of said pinch rollers.

5. A mechanism for establishing individually adjustable roller bite bias pressures between paper drive roller means mounted upon a frame and a corresponding plurality of pinch rollers, shiftable with respect to said frame, comprising:

biasing link means having a first portion rotatably mounted upon said frame by a first pivot means;

a plurality of pinch roller support link means actuated by said biasing link means, each supporting one of said pinch rollers;

roller biasing isolation means for independently coupling each roller support means to said frame;

handle link means having a first portion thereof pivotably coupled to said frame by a second pivot means;

toggle link means having a first portion thereof rotatably coupled to a second portion of said handle link means by a third pivot means and having a second portion thereof coupled to a second portion of said spring loading link means by a fourth pivot means;

a plurality of individually adjustable mechanical biasing means for asserting forces upon said roller support link means;

means for coupling said mechanical biasing means to said biasing link means for causing said pinch rollers to press againt said drive roller means while producing a torque tending to rotate said biasing link means about said first pivot means in a first direction for maintaining said handle link means in a closed position when said third pivot means is on one side of a reference line intersecting said second and fourth pivot means, and for producing rotation of said handle link means about said second pivot means in a second direction opposite said first direction when said third pivot means is on the other side of said reference line, to enable full separation of said pinch rollers from said drive roller means.

6. The combination as set forth in claim 5 wherein each of said plurality of pinch roller support link means is individually coupled to rotate about said first pivot means and contains a pinch roller rotatably mounted therein.

7. The combination as set forth in claim 6 further including means for individually varying the forces asserted by each of said mechanical biasing means upon an associated pinch roller support link means.

8. The combination as set forth in claim 7 wherein said drive roller means comprises a plurality of drive rollers, each associated with one of said pinch rollers.

9. A mechanism for establishing individually adjustable roller bite pressure between paper drive roller means mounted upon a frame and a corresponding plurality of pinch rollers, shiftable with respect to said frame, comprising:

spring loading link means having a first portion rotatably mounted upon said frame by a first pivot means;

a plurality of roller support link means, each supporting one of said pinch rollers;

roller biasing isolation means for independently coupling each roller support means to said frame;

handle link means having a first portion thereof pivotably coupled to said frame by a second pivot means;

toggle link means having a first portion thereof rotatably coupled to a second portion of said handle link means by a third pivot means and having a second portion thereof coupled to a second portion of said spring loading link means by a fourth pivot means;

a plurality of spring loading means for asserting forces upon said roller support link means;

means for coupling said spring loading means to said spring loading link means for causing said pinch rollers to press against said drive roller means while producing a torque tending to rotate said spring loading link means about said first pivot means in a first direction for maintaining said handle link means in the closed position when said third pivot means is on one side of a reference line intersecting said second and fourth pivot means, and for producing rotation of said handle link means about said second pivot means in a second direction opposite said first direction when said third pivot means is on the other side of said reference line, to enable full separation of said pinch rollers from said drive roller means.

10. The combination as set forth in claim 9 wherein each of said plurality of roller support link means is individually coupled to rotate about said first pivot means and contains a pinch roller rotatably mounted therein.

11. The combination as set forth in claim 10 further including means for individually varying the forces asserted by each of said spring loaded plunger means upon an associated roller support means.

12. The combination a set forth in claim 11 wherein said drive roller means comprises a plurality of drive rollers, each associated with one of said pinch rollers.

13. A mechanism for establishing individually adjustable roller bite pressures between paper drive roller means mounted upon a frame and a corresponding plurality of pinch rollers, shiftable with respect to said frame, comprising:

spring loading link means having a first portion rotatably mounted upon said frame by a first pivot means;

a plurality of roller support means actuated by said spring loading link means, each rotatably supporting one of said pinch rollers;

roller biasing isolation means for independently coupling each roller support means to said frame;

handle link means having a first portion thereof pivotably coupled to said frame by a second pivot means;

toggle link means having a first portion thereof rotatably coupled to a second portion of said handle link means by a third pivot means and having a second portion thereof coupled to a second portion of said spring loading link means by a fourth pivot means;

a stop coupled to said frame for arresting the rotation of said handle link means;

a plurality of spring loaded plunger means each asserting forces upon an associated roller support means;

means for coupling said spring loaded plunger means to said spring loading link means for causing said pinch rollers to press against said drive roller means while producing a torque tending to rotate said handle link means about said second pivot means in a first direction for maintaining said handle link means against said stop when said third pivot means is on one side of a reference line intersecting said second and fourth pivot means, and for producing rotation of said handle link means about said second pivot means in a second direction opposite said first direction when said third pivot means is on the other side of said reference line, to enable full separation of said pinch rollers from said drive roller means.

14. The combination as set forth in claim 13 wherein each of said plurality of roller support link means is individually coupled to rotate about said first pivot means and contains a pinch roller rotatably mounted therein.

15. The combination a set forth in claim 14 further including means for individually varying the forces asserted by each of said spring loaded plunger means upon an associated roller support link means.

16. The combination as set forth in claim 15 wherein said drive roller means comprises a plurality of drive rollers, each associated with one of said pinch rollers.

17. A mechanism for establishing individually adjustable roller bite pressure between a plurality of paper drive rollers mounted upon a frame and a corresponding plurality of pinch rollers, shiftable with respect to said frame, comprising:

spring loading link means having a lower portion rotatably mounted upon said frame by a first pivot means;

a plurality of roller cradle link means actuated by a first crossbar means member coupled to said spring loading link means, each rotatably supporting one of said pinch rollers;

roller biasing isolation means for independently rotatably coupling each roller support means to said frame;

handle link means having a first upper terminal portion thereof pivotably coupled to said frame by a second pivot means positioned above said first pivot means;

toggle link means having a first terminal portion thereof rotatably coupled to a lower portion of said handle link means by a third pivot means and having a second terminal portion thereof coupled to a lower portion of said spring loading link means by a fourth pivot means;

a stop coupled to said frame for arresting the rotation of a second terminal portion of said handle link means widely separated from the first terminal portion thereof;

a plurality of spring loaded plunger means for asserting forces upon the upper portions of said roller cradle link means;

second crossbar means for rigidly coupling said spring loaded plunger means to said spring loading link means for causing said pinch rollers to press against said drive rollers while producing a torque tending to rotate said handle link means about said second pivot means in a first direction for maintaining said handle link means against said stop when said third pivot means is on one side of a reference line intersecting said second and fourth pivot means, and for producing rotation of said handle link means about said second pivot means in a second direction opposite said first direction when said third pivot means is on the other side of said reference line, to enable full separation of said pinch rollers from said drive rollers.

18. The combination as set forth in claim 17 wherein each of said plurality of roller cradle link means is individually coupled to rotate about said first pivot means and contains a pinch roller rotatably mounted therein.

19. The combination as set forth in claim 18 further including means for individually varying the forces asserted by each of said spring loaded plunger means upon an associated cradle link means.

20. A mechanism for establishing individually adjustable roller bite bias pressures between paper drive roller means mounted upon a frame and a corresponding plurality of pinch rollers, shiftable with respect to said frame, comprising:

biasing link means having a first portion mounted upon said frame by a first coupling means;

a plurality of roller support means actuated by said biasing means, each rotatably supporting one of said pinch rollers;

roller biasing isolation means for independently coupling each roller support means to said frame;

handle link means having a first portion thereof coupled to said frame by a second coupling means;

intermediate link means having a first portion thereof coupled to a second portion of said handle link means by a third coupling means and having a second portion thereof coupled to a second portion of said biasing link means by a fourth coupling means;

motion arresting means coupled to said frame for arresting the motion of said handle link means;

a plurality of mechanical biasing means for asserting downward forces upon said pinch roller support means;

means for coupling said mechanical biasing means to said biasing link means for causing said pinch rollers to press against said drive roller means while producing a torque tending to move said handle link means with respect to said second coupling means in a first direction for maintaining said handle link means in the closed position and for producing motion of said handle link means with respect to said second coupling means in a second direction opposite said first direction upon opening said mechanism to enable full separation of said pinch rolles from said drive roller means.

21. The combination as set forth in claim 20 wherein each of said pinch roller support means is individually coupled to rotate independently with respect to said frame.

22. The combination as set forth in claim 21 further including means for individually varying the forces asserted by each of said mechanical biasing means upon an associated pinch roller support means.

23. The combination as set forth in claim 22 wherein said drive roller means comprises a plurality of drive rollers, each associated with one of said pinch rollers.

24. A mechanism for establishing individually adjustable roller bite bias pressures between paper drive roller means mounted upon a frame and a corresponding plurality of pinch rollers, shiftable with respect to said frame, comprising:

biasing link means having a first portion mounted upon said frame by a first coupling means;

a plurality of roller support means actuated by said biasing link means, each supporting one of said pinch rollers;

roller biasing isolation means for independently coupling each roller support means to said frame;

handle link means having a first portion thereof coupled to a second portion of said handle link means by a third coupling means and having a second portion thereof coupled to a second portion of said biasing link means by a fourth coupling means;

a plurality of mechanical biasing means for asserting forces upon said pinch roller support means;

means for coupling said mechanical biasing means to said biasing link means for causing said pinch rollers to press against said drive roller means while producing a force tending to move said roller position control link means with respect to said second coupling means in a first direction for maintaining said handle link means in the closed position and for producing motion of said handle link means with respect to said second coupling means in a second direction opposite said first direction upon opening said mechanism to enable full separation of said pinch rollers from said drive roller means.

25. The combination a set forth in claim 24 wherein each of said pinch roller support means is individually coupled to move with respect to said first coupling means and contains a pinch roller rotatably mounted therein.

26. The combination as set forth in claim 25 further including means for individually varying the forces asserted by each of said mechanical biasing means upon an associated pinch roller support means.

27. The combination as set forth in claim 26 wherein said drive roller means comprises a plurality of drive rollers, each associated with one of said pinch rollers.

* * * * *